US007922361B2

(12) United States Patent
Chen

(10) Patent No.: US 7,922,361 B2
(45) Date of Patent: Apr. 12, 2011

(54) LIGHT-EMITTING DIODE ILLUMINATING EQUIPMENT WITH HIGH POWER AND HIGH HEAT DISSIPATION EFFICIENCY

(75) Inventor: Jen-Shyan Chen, Hsinchu (TW)

(73) Assignee: Neobulb Technologies, Inc. (BN)

( * ) Notice: Subject to any disclaimer, the term of this patent is extended or adjusted under 35 U.S.C. 154(b) by 316 days.

(21) Appl. No.: 11/990,638

(22) PCT Filed: Aug. 19, 2005

(86) PCT No.: PCT/CN2005/001301

§ 371 (c)(1),
(2), (4) Date: Feb. 19, 2008

(87) PCT Pub. No.: WO2007/019733

PCT Pub. Date: Feb. 22, 2007

(65) Prior Publication Data

US 2009/0256458 A1 Oct. 15, 2009

(30) Foreign Application Priority Data

Aug. 19, 2005 (CN) ..... 2005 1 0092114

(51) Int. Cl.
*F21V 29/00* (2006.01)

(52) U.S. Cl. ..... 362/294; 362/373; 362/545

(58) Field of Classification Search ..... 362/294, 362/373, 249.02, 547, 345, 218; 174/15.1–15.2, 174/16.3; 165/104.33
See application file for complete search history.

(56) References Cited

U.S. PATENT DOCUMENTS

| | | | | |
|---|---|---|---|---|
| 3,739,234 | A * | 6/1973 | Bylund et al. | 257/715 |
| 4,976,308 | A * | 12/1990 | Faghri | 165/10 |
| 5,000,252 | A * | 3/1991 | Faghri | 165/10 |
| 6,517,221 | B1 * | 2/2003 | Xie | 362/373 |
| 7,198,386 | B2 * | 4/2007 | Zampini et al. | 362/294 |
| 7,331,691 | B2 * | 2/2008 | Livesay et al. | 362/294 |
| 2004/0213016 | A1 * | 10/2004 | Rice | 362/547 |
| 2005/0039890 | A1 * | 2/2005 | Lee et al. | 165/104.33 |
| 2005/0111234 | A1 * | 5/2005 | Martin et al. | 362/555 |

OTHER PUBLICATIONS

International Search Report of PCT/CN2005/001301 mailed May 25, 2006.

* cited by examiner

*Primary Examiner* — John A Ward
(74) *Attorney, Agent, or Firm* — Thomas, Kayden, Horstemeyer & Risley, LLP.

(57) ABSTRACT

The invention provides light-emitting diode illuminating equipment with high power and high heat-dissipation efficiency. The light-emitting diode illuminating equipment comprises a casing and N first packaged systems. Each of the first packaged systems comprises a first heat pipe, at least one first heat-dissipating fin, and a first diode light-emitting apparatus. Wherein a heat generated during the operation of the first diode light-emitting apparatus is conducted by the first heat pipe from the flat portion of the first heat pipe to the at least one first heat-dissipating fin, and then is dissipated by the at least one first heat-dissipating fin. In particular, the light-emitting diode illuminating equipment, according to the invention, is very suitable to be used as a street lamp.

11 Claims, 3 Drawing Sheets

LIGHT-EMITTING DIODE ILLUMINATING EQUIPMENT WITH HIGH POWER AND HIGH HEAT DISSIPATION EFFICIENCY

BACKGROUND OF THE INVENTION

1. Field of the Invention

The invention relates to a light-emitting diode illuminating equipment, and more particularly, to a system-in-package light-emitting diode lamp with high power and high heat-dissipation efficiency.

2. Description of the Prior Art

Because light-emitting diodes have the advantages of electricity-saving, vibration-resisting, fast responding, and being suitable for mass production etc., illuminating equipments using light-emitting diode as light sources continue to be investigated and developed. However, current high power light-emitting diodes have the problem of overheating after being used for a long span of time, causing the reduction of lighting efficiency of light-emitting diodes and limiting the brightness. Therefore, all kinds of products applying light-emitting diodes require good heat-dissipation mechanisms.

Accordingly, the invention provides a light-emitting diode illuminating equipment with high power and high heat-dissipation efficiency. In particular, the light-emitting diode illuminating equipment, according to the invention, is very suitable to be used as a street lamp.

SUMMARY OF THE INVENTION

A scope of the invention is to provide a light-emitting diode illuminating equipment. The light-emitting diode illuminating equipment, according to a preferred embodiment of the invention, includes a casing and N first packaged systems. The casing has a bottom and N side walls with N first formed-through apertures provided on the bottom and a respective second formed-through aperture provided on each of the side walls, where N is an integer larger than 2.

Each of the N first packaged systems corresponds to one of the N side walls and one of the N first apertures. Each of the first packaged systems includes a first heat-conducting device, at least one first heat-dissipating fin, and a first diode light-emitting apparatus. The first heat-conducting device is divided into a neck portion adapted to the corresponding first aperture and the corresponding second aperture, a flat portion at the distal end of the neck portion, and a tail portion. The first heat-conducting device is inserted through the corresponding second aperture via the neck portion thereof to protrude into the first aperture, such that the tail portion of the first heat-conducting device is disposed outside the corresponding side wall. The at least one first heat-dissipating fin is mounted on a periphery of the tail portion of the first heat-conducting device.

The first diode light-emitting apparatus is flatly mounted on the flat portion of the first heat-conducting device for converting a first electric energy into a first light. The heat generated during the operation of the first diode light-emitting apparatus is conducted by the first heat-conducting device from the flat portion of the first heat-conducting device to the at least one first heat-dissipating fin, and then it is dissipated by the at least one first heat-dissipating fin.

Because the light-emitting diode illuminating equipment, according to the invention, combines the heat conducting/dissipating modules with the light-emitting diode module, the heat generated by the light-emitting diode module can be dissipated to the atmosphere immediately by the heat-dissipating fins of the heat conducting/dissipating modules to greatly enhance the heat-dissipation efficiency. Therefore, compared to the prior art, the diode lamp according to the invention applies more suitably on the illuminating equipment requiring the light-emitting diode with high heat-dissipation efficiency. In particular, the light-emitting diode illuminating equipment, according to the invention, is very suitable to be used as a street lamp.

The advantage and spirit of the invention may be understood by the following recitations together with the appended drawings.

BRIEF DESCRIPTION OF THE APPENDED DRAWINGS

DETAILED DESCRIPTION OF THE INVENTION

The primary scope of the invention is to provide a light-emitting diode illuminating equipment.

Figure 1:
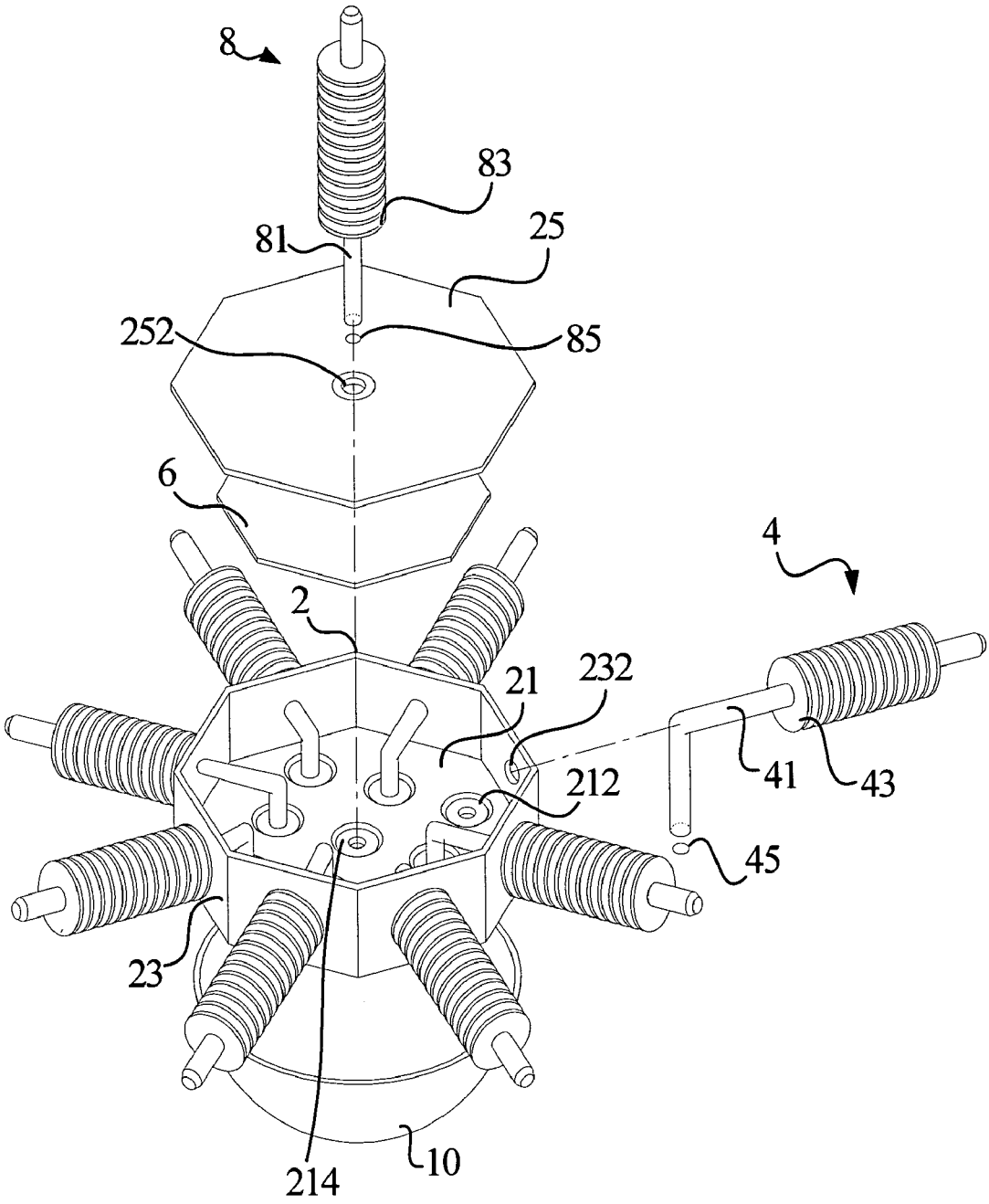
FIG. 1 is a blown-up diagram of a light-emitting diode illuminating equipment according to a preferred embodiment of the invention.

Referring to FIG. 1, FIG. 1 is a blown-up diagram of a light-emitting diode illuminating equipment 1 according to a preferred embodiment of the invention. The light-emitting diode illuminating equipment 1 includes a casing 2 and N first packaged systems 4. The casing 2 has a bottom 21 and N side walls 23, where N is an integer larger than 2. N first formed-through apertures 212 are provided on the bottom 21, and a respective second formed-through aperture 232 is provided on each of the side walls 23.

Each of the N first packaged systems 4 corresponds to one of the N side walls 23 and one of the N first apertures 212. Each of the first packaged systems 4 includes a first heat-conducting device 41, at least one first heat-dissipating fin 43, and a first diode light-emitting apparatus 45. The first heat-conducting device 41 is divided into a neck portion adapted to the corresponding first aperture 212 and the corresponding second aperture 232, a flat portion at the distal end of the neck portion, and a tail portion. The first heat-conducting device 41 is inserted through the corresponding second aperture 232 via the neck portion thereof to protrude into the first aperture 212 such that the tail portion of the first heat-conducting device is disposed outside the corresponding side wall 23. The at least one first heat-dissipating fin 43 is mounted on the periphery of the tail portion of the first heat-conducting device 41. The first diode light-emitting apparatus 45 is flatly mounted on the flat portion of the first heat-conducting device 41, for converting a first electric energy into a first light. The heat generated during the operation of the first diode light-emitting apparatus 45 is conducted by the first heat-conducting device 41 from the flat portion of the first heat-conducting device to the at least one first heat-dissipating fin 43, and then it is dissipated by the at least one first heat-dissipating fin 43.

In one embodiment, the bottom 21 of the casing of the light-emitting diode illuminating equipment 1 provides a third formed-through aperture 214. The casing also has a top 25, and the top 25 of the casing provides a fourth formed-through aperture 252. The light-emitting diode illuminating equipment 1 further includes a second packaged system 8. The second packaged system includes a second heat-conducting device 81, at least one second heat-dissipating fin 83, and a second diode light-emitting apparatus 85.

The second heat-conducting device 81 is divided into a neck portion adapted to the third aperture 214 and the fourth aperture 252, a flat portion at the distal end of the neck portion, and a tail portion. The second heat-conducting device 81 is inserted through the fourth aperture 252 via the neck portion thereof to protrude into the third aperture 214 such that the tail portion of the second heat-conducting device is disposed outside the top 25. The at least one second heat-dissipating fin 83 is mounted on the periphery of the tail portion of the second heat-conducting device 81. The second diode light-emitting apparatus 85 is flatly mounted on the flat portion of the second heat-conducting device 81, for converting a second electric energy into a second light. The heat generated during the operation of the second diode light-emitting apparatus 85 is conducted by the second heat-conducting device 81 from the flat portion of the second heat-conducting device to the at least second one heat-dissipating fin 83, and then it is dissipated by the at least one second heat-dissipating fin 83.

Similarly, referring to FIG. 1, in one embodiment, the light-emitting diode illuminating equipment 1 further includes a circuit board 6 respectively electrically connected to the N first diode light-emitting apparatuses 45 and capable of being electrically connected to a power source for providing the N first diode light-emitting apparatuses 45 with the first electric energy. The circuit board 6 is also electrically connected to the second diode light-emitting apparatus 85 to provide the second diode light-emitting apparatus with the second electric energy.

In one embodiment, N is equal but not necessarily limited to eight. Consequently, the bottom of the casing of the above embodiment provides eight first formed-through apertures and a third formed-through aperture. The casing also has eight sidewalls respectively providing a second formed-through aperture, eight first diode light-emitting apparatus, and a second diode light-emitting apparatus. Hence, the arrangements of the apertures on the bottom of the casing and the diode light-emitting apparatus are in arrays. However, the arrangement is not necessarily an array when N is equal to another integer larger than 2.

Figure 2:
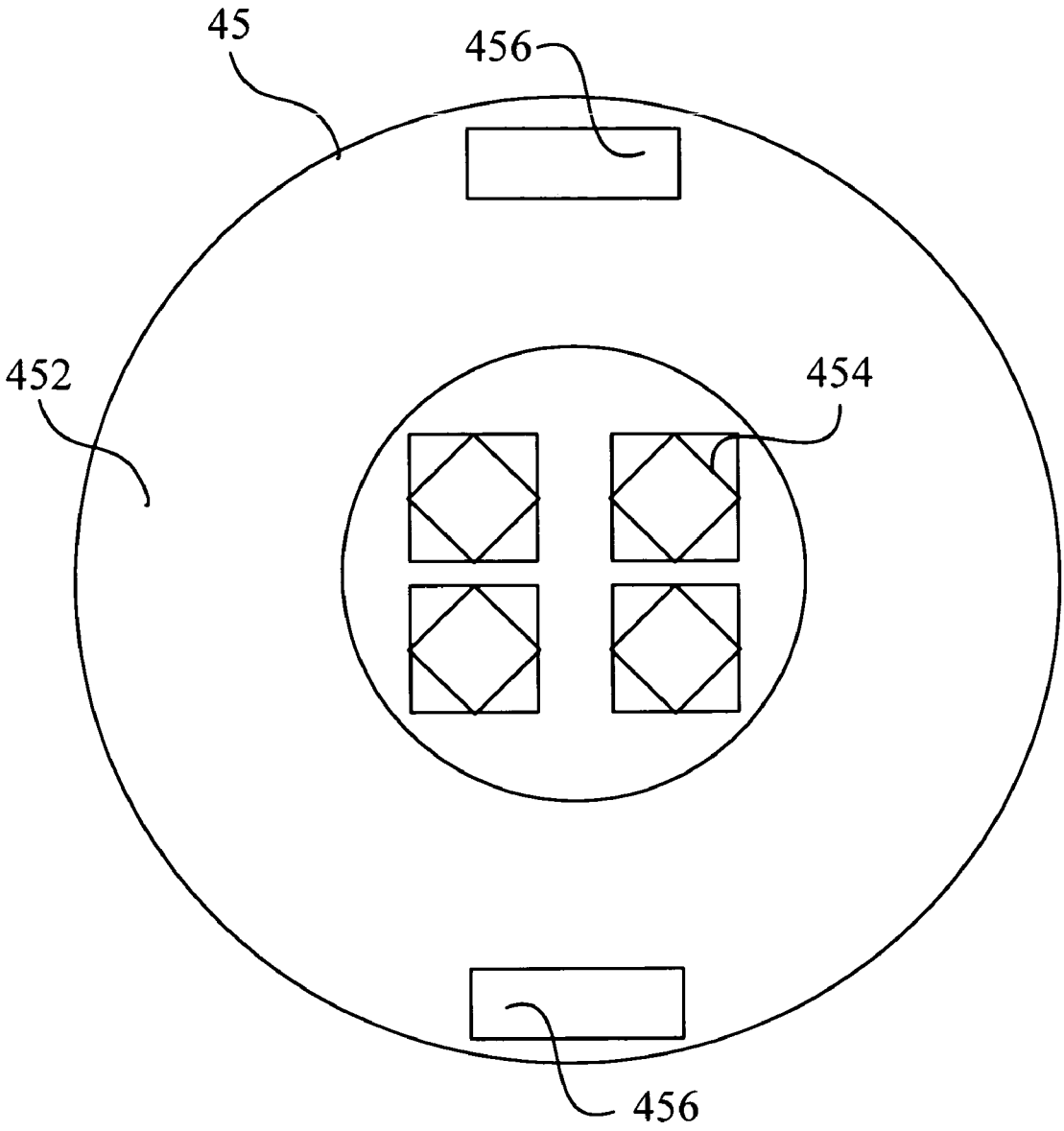
FIG. 2 is a structural diagram of the first diode light-emitting apparatus according to one embodiment of the invention.

Referring to FIG. 2, FIG. 2 is a structural diagram of the first diode light-emitting apparatus 45 according to one embodiment of the invention. Each of the first diode light-emitting apparatuses 45 includes a first substrate 452, a first light-emitting module 454, isolatedly mounted on the first substrate, and two first electrodes 456 also isolatedly mounted on the first substrate 452.

In one embodiment, the second diode light-emitting apparatus includes a second substrate, a second light-emitting module, isolatedly mounted on the second substrate, and two second electrodes also isolatedly mounted on the second substrate.

Figure 3:
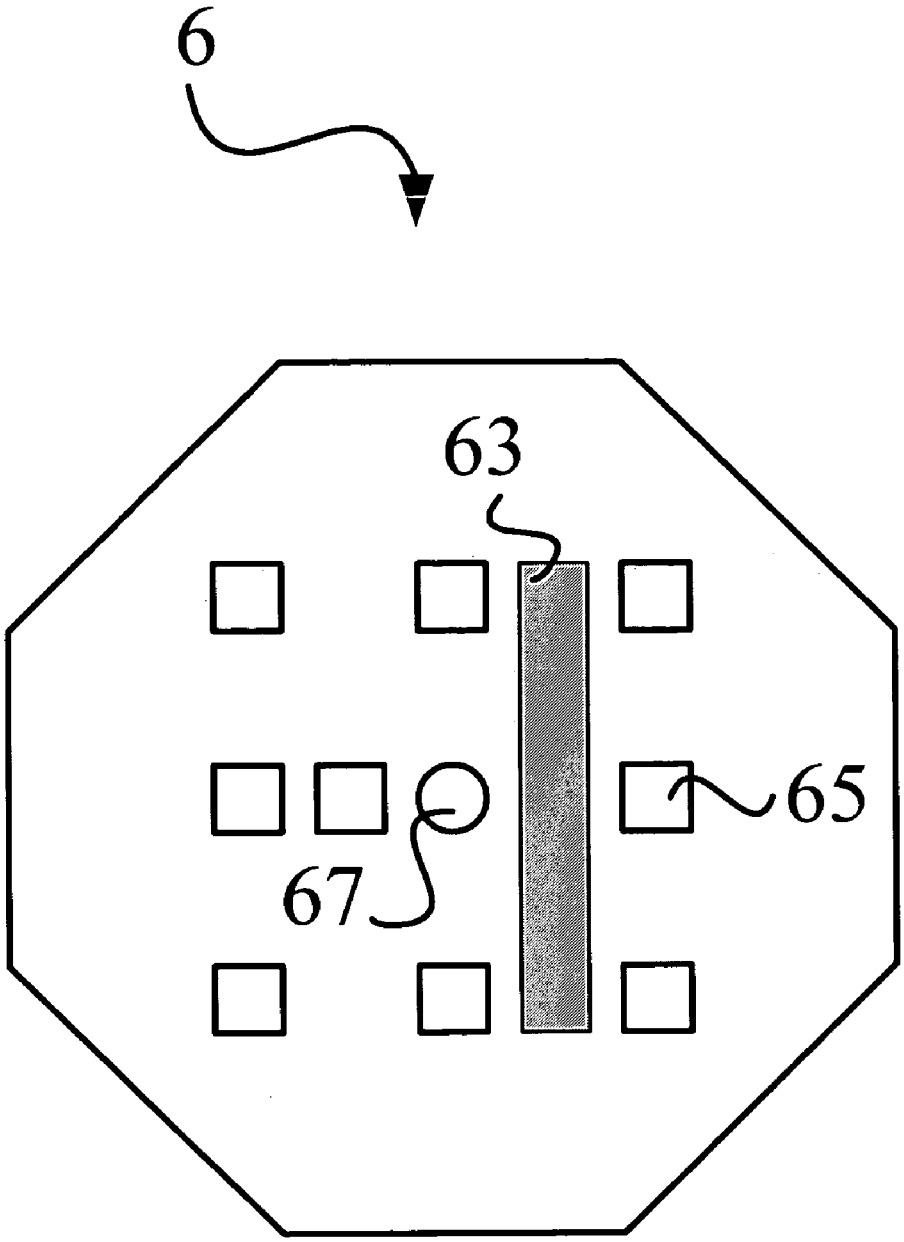
FIG. 3 is a structural schematic diagram of the circuit board according to one embodiment of the invention.

Referring to FIG. 3, FIG. 3 is a structural schematic diagram of the circuit board 6 according to one embodiment of the invention. In one embodiment, the circuit board 6 includes a connector 63, nine connecting devices 65, and an aperture 67. The circuit board 6 disposed on an inner side of the top 25 of the casing is respectively electrically connected through the nine connecting devices 65 to the electrodes 456 of each of the first diode light-emitting apparatuses 45 and the electrodes of the second diode light-emitting apparatus 85. The aperture 67 corresponding to the fourth aperture allows the second heat-conducting device to protrude through. The circuit board 6 is electrically connected to the connector 63, and the connector 63 is electrically connected to the power source.

In one embodiment, the power source is an AC power source. The light-emitting diode illuminating equipment 1 further includes a power supply, for converting an AC electrical current supplied by AC power source into a DC electric current. The connector is electrically connected through the power supply to the power source. In one embodiment, the power source is a DC power source.

In one embodiment, each of the first heat-conducting devices and the second heat-conducting device respectively is a heat column or a heat pipe. Each of the first heat-conducting device and the second heat-conducting device respectively is formed of a copper material, an aluminum material, or a material with high heat conductivity.

In one embodiment, each of first light-emitting apparatuses and the second light-emitting apparatus respectively includes at least one light-emitting diode or at least one laser diode.

In one embodiment, each of the first substrates and the second substrate respectively is formed of a semiconductor material, a metal material, a polymer material, or a ceramic material Referring to FIG. 1, in one embodiment, the light-emitting diode illuminating equipment 1 further includes a transparent lamp shade 10 mounted on the exterior of the bottom 21 of the casing and covering the N first apertures 212 and the third aperture 214.

The invention provides the diode lamp of the light-emitting diode illuminating equipment where the heat conducting/dissipating modules and light-emitting diode chip are packaged together. The heat generated by the light-emitting diode chip can be dissipated to the atmosphere immediately by the heat-dissipating fins of the heat conducting/dissipating modules to greatly enhance the heat-dissipation efficiency. The improvement of the heat dissipation efficiency of the diode lamp solves the problem of power reduction of the light-emitting diode due to overheating. Also, the lighting efficiency of the light-emitting diode illuminating equipment according to the invention can be enhanced. Accordingly, compared to the prior art, the light-emitting diode illuminating equipment according to the invention applies more suitably on the light-emitting diode illuminating apparatus requiring high power and high heat-dissipation efficiency, especially on a street lamp.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A light-emitting diode illuminating equipment, comprising:

a casing having a bottom and side walls, N first formed-through apertures being provided on the bottom, and N second formed-through apertures being provided on the side walls, N being an integer larger than 2; and N first packaged systems corresponding to the N first apertures respectively, each of the first packaged systems comprising:

a first heat pipe comprising a flat portion, a neck portion and a tail portion, wherein the neck portion protruding into one of the first apertures, the flat portion being disposed on a distal end of the neck portion and exposed outside the casing, the tail portion protruding into one of the second apertures, the neck portion extending along a first direction toward the flat portion, and the tail portion extending along a second direction toward the neck portion;

at least one first heat-dissipating fin mounted on a periphery of the tail portion of the first heat pipe; and a first diode light-emitting apparatus, flatly mounted on the flat portion of the first heat pipe, for converting a first electric energy into a first light, and the first diode light-emitting apparatus comprising a plurality of light-emitting diodes and all of the plurality of light-emitting diodes being disposed within periphery of the flat portion;

wherein a heat generated during the operation of the first diode light-emitting apparatus is conducted by the first heat pipe from the flat portion of the first heat pipe to the at least one first heat-dissipating fin, and then is dissipated by the at least one first heat-dissipating fin, and the first direction of each heat pipe is approximately parallel to each other.

2. The light-emitting diode illuminating equipment of claim 1, wherein the bottom of the casing thereon provides a third formed-through aperture, the casing also has a top, the top of the casing thereon provides a fourth formed-through aperture, said light-emitting diode illuminating equipment further comprises a second packaged system, the second packaged system comprises:

a second heat pipe divided into a neck portion adapted to the third aperture and the fourth aperture, a flat portion at a distal end of the neck portion and a tail portion, the second heat pipe inserted through the fourth aperture being via the neck portion thereof and protruding into the third aperture such that the tail portion of the second heat pipe is disposed outside the top;

at least one second heat-dissipating device mounted on a periphery of the tail portion of the second heat pipe; and a second diode light-emitting apparatus, flatly mounted on the flat portion of the second heat pipe, for converting a second electric energy into a second light;

wherein the heat generated during the operation of the second diode light-emitting apparatus is conducted by the second heat pipe from the flat portion of the second heat pipe to the at least second one heat-dissipating fin, and then is dissipated by the at least one second heat-dissipating fin.

3. The light-emitting diode illuminating equipment of claim 2, further comprising a circuit board respectively electrically connected to the N first diode light-emitting apparatuses and capable of being electrically connected to a power source for providing the N first diode light-emitting apparatuses with the first electric energy, the circuit board being also electrically connected to the second diode light-emitting apparatus to provide the second diode light-emitting apparatus with the second electric energy.

4. The light-emitting diode illuminating equipment of claim 3, wherein each of the first diode light-emitting apparatuses comprises a first substrate, a first light-emitting module, isolatedly mounted on the first substrate, and two first electrodes also isolatedly mounted on the first substrate, the second diode light-emitting apparatus comprises a second substrate, a second light-emitting module, isolatedly mounted on the second substrate, and two second electrodes also isolatedly mounted on the second substrate.

5. The light-emitting diode illuminating equipment of claim 4, wherein each of first light-emitting apparatuses and the second light-emitting apparatus respectively comprise at least one light-emitting diode or at least one laser diode, the second light-emitting apparatus further comprises a plurality of light-emitting diodes.

6. The light-emitting diode illuminating equipment of claim 4, wherein each of the first substrates and the second substrate respectively are formed of a semiconductor material, a metal material, a polymer material, or a ceramic material.

7. The light-emitting diode illuminating equipment of claim 3, wherein each of the first heat pipe and the second heat pipe respectively are formed of a copper material, an aluminum material or a material with high heat conductivity.

8. The light-emitting diode illuminating equipment of claim 4, wherein the circuit board comprises a connector capable of being electrically connected to the power source, the circuit board is disposed on an inner side of the top of the casing, the circuit board is respectively electrically connected to the electrodes of each of the first diode light-emitting apparatuses and the electrodes of the second diode light-emitting apparatus, the circuit board is also electrically connected to the connector.

9. The light-emitting diode illuminating equipment of claim 8, wherein the power source is an AC power source, said light-emitting diode illuminating equipment further comprises power supply for converting an AC electrical current supplied by AC power source into a DC electric current, the connector is electrically connected through the power supply to the power source.

10. The light-emitting diode illuminating equipment of claim 8, wherein the power source is DC power source.

11. The light-emitting diode illuminating equipment of claim 3, further comprising a transparent lamp shade mounted on the exterior of the bottom of the casing and covering the N first apertures and the third aperture.

* * * * *